US005881520A

United States Patent [19]

Blazevic

[11] Patent Number: 5,881,520

[45] Date of Patent: Mar. 16, 1999

[54] INTEGRAL METAL STRUCTURAL POST FOR THE ERECTION OF TWO PAIRS OF INTERIOR WALLS

[76] Inventor: Drago Blazevic, R.R. #1, Site 8, Box 28, Waverly, Nova Scotia, Canada, B0N 2S0

[21] Appl. No.: 823,520

[22] Filed: Mar. 24, 1997

Related U.S. Application Data

[63] Continuation of Ser. No. 463,018, Jun. 5, 1995.

[51] Int. Cl.[6] ..... E04C 2/08; E04C 3/32

[52] U.S. Cl. ..... 52/281; 52/283; 52/481.1; 52/483.1; 52/730.6; 52/731.9; 52/733.2

[58] Field of Search ..... 52/281, 283, 481.1, 52/483.1, 730.6, 731.9, 733.2

[56] References Cited

U.S. PATENT DOCUMENTS

| | | |
|---|---|---|
| 1,075,845 | 10/1913 | Mills . |
| 1,658,407 | 2/1928 | Gustaveson . |
| 2,005,146 | 6/1935 | Kotrbaty . |
| 2,010,848 | 8/1935 | Dix . |
| 3,226,906 | 1/1966 | Koerner . |
| 3,286,429 | 11/1966 | Ratliff, Jr. . |
| 3,877,194 | 4/1975 | Matuschek et al. . |
| 4,019,302 | 4/1977 | Meyer . |
| 4,466,225 | 8/1984 | Hovind . |
| 4,619,098 | 10/1986 | Taylor . |

FOREIGN PATENT DOCUMENTS

| | | |
|---|---|---|
| 157305 | 1/1911 | Canada . |
| 266651 | 12/1926 | Canada . |
| 324361 | 7/1932 | Canada . |
| 695368 | 10/1964 | Canada . |
| 697320 | 11/1964 | Canada . |
| 857130 | 12/1970 | Canada . |
| 858168 | 12/1970 | Canada . |
| 1073182 | 3/1980 | Canada . |

*Primary Examiner*—Christopher Kent
*Attorney, Agent, or Firm*—Ezra Sutton

[57] ABSTRACT

An integral metal structural post is provided for the erection of two pairs of interior walls. Each such pair of walls includes interior walls which are disposed at right angles to one another. The structural post includes a first elongate metal angle bar having an "L"-shaped cross-section, the two arms having a particularly recited structure, a second identical elongate metal angle bar, arranged in mirror-image relationship to the first elongate metal angle bar, and an elongate web interconnecting the two elongate metal angle bars in a particular manner. Because of the particulary recited structures of the arms of the elongate metal angle bars, an interior wallboard or interior sheathing is secured directly to respective ones of the four interior faces of the two elongate metal angle bars. When such securing is effected, two interior comers are created.

11 Claims, 9 Drawing Sheets

1106
1109
1111
700
1100
1108

1102
1104
1111
1110
1103
1104

1107
1105
1109
1108
1108
1101
1108
1100
1110

1105

1113
1109
1112
1105
1106
1105
1101
1108
1113
1110
1111
600
1112
1105

INTEGRAL METAL STRUCTURAL POST FOR THE ERECTION OF TWO PAIRS OF INTERIOR WALLS

RELATED APPLICATIONS

This application is a continuation of copending application Ser. No. 08/463,018, filed Jun. 5, 1995.

BACKGROUND OF THE INVENTION (i). Field of the Invention

The present invention relates to building construction. More particularly it relates to a composite corner post for providing at least two interior walls.

(ii). Description of the Prior Art

In recent years, more and more effort has been expended by builders and the building trades to improve construction and reduce the costs of construction. Many new construction methods have been devised but these, contrary to the present invention, have been restricted almost exclusively to large building construction. In the prior art heretofore the improvements in home construction have been restricted to the introduction of new materials. For example, corner post construction, whether it be for an outside corner, i.e., a corner in the outside wall of a house, or an intersecting corner, has been the same for a very long time. The ordinary way to assemble corner posts in the past has been to secure studs together to make a solid post. Sometimes blocks were used as spacers, particularly in the case of intersecting corner posts. These posts were normally assembled on the construction site by using a sufficient amount of studding material to make a solid post. The studs were normally 2×3's, 2×4's or 2×6's and at least three pieces were generally needed to construct a corner post. Outside corner posts were made of three pieces and intersecting corner posts were made of three or four pieces and often included filler blocks.

The wall finish material, e.g., wallboard, gypsum board, or lath and plaster, were secured at the corner of the three studs. In setting a new partition in an old building, difficulty was found to be encountered in properly securing the new studs in the old wall while preventing damage to the cut ends of the old wall finish material.

This type of construction is not desirable, since the creating of the corner posts used a considerable amount of lumber and nails and, more importantly it was time consuming and labour intensive. These factors were especially significant because they directly affected the cost of building.

Steel structural members or studs in the form of c-beams and box 2×3's, 2×4's or 2×6's have been used for a number of years in construction work as framing for interior walls and for exterior walls which support, for example, plaster board and exterior sheathing. Such steel studs, when used as structural members for exterior walls, had a primary drawback in that they readily conducted exterior heat into the air-conditioned building in the summer, and did the reverse in winter when the heat loss in cold weather was found to be so serious that the walls were discoloured (called "shadowing"), as moisture, including greasy dirt, was deposited on the colder parts of the wall in direct contact with the steel beams supporting the wall.

Combination wood/steel beams and/or studs have also been suggested, and patented, in an effort to improve the above-identified building construction. For example, U.S. Pat. No. 1,075,845, patented Oct. 14, 1913, by J. H. Mills, provided a structural material which included parallel wooden strips spaced apart, and two strips of sheet metal extending across and covering two opposite edges of the wooden strips, leaving two opposite sides thereof exposed for nailing purposes. Both the wooden and metal strips constituted an integral structure and an article of commerce. The metallic strip had tongues stamped out therefrom and embedded into the wood for securing the wooden and metallic strips together.

U.S. Pat. No. 1,658,407, patented Feb. 7, 1928, by P. Gustaveson, provided a nailing block for composite walls. The patented block was provided as the combination with a flanged metal wall member, having one of its faces formed so as to fit between the flanges of the wall-forming member. Vertically-disposed shoulders were formed on the side faces of the block for engagement with the edges of the flanges of the wall-forming member. An open loop of resilient metal was provided for securing the nailing block to the wall member.

U.S. Pat. No. 2,005,146, patented Jun. 18, 1935, by G. F. Kotrbaty, provided a self-supporting building member and joint. Such building member was provided in a wall construction including a plurality of juxtaposed building units having spaced wall sections and end sections joining the wall sections. The end sections were provided with centrally-disposed, tongue-receiving slots and channel sections on either side of the slot sections. A tongue keying member having resilient clip members thereon, extending from opposite sides and substantially-parallel to the member, was disposed between abutted building units, and was in locking relation with the tongue receiving slots.

U.S. Pat. No. 2,010,848, patented Aug. 13, 1935, by H. W. Dix, provided a structural unit building member, which included, in combination, parallel wall sections and end sections bridging the wall sections. The end sections included a central portion and lateral channel portions, one of the central portions having vertical tongue-receiving slots, another of the central portions having outwardly extending tongues insertable in the slots. Transverse vertical slots were provided in lateral alignment with the first slots.

U.S. Pat. No. 3,226,906, patented Jan. 4, 1966, by C. W. Koerner, provided a building corner post and bracket, which included a plurality of vertically-spaced brackets, each of the brackets comprising a body member having two offset sections, a first section and a second section. These sections were connected together at adjacent corners forming two opposed rectangular recesses on opposite sides of the bracket. Each of the sections had a pair of flanges secured thereto in a perpendicular relationship to the body member, the flanges being secured to the edges of the sections adjacent the recesses. A first upright member was secured in one recess to one of the flanges from the first section and one of the flanges from the second section. A second upright was secured in the other recess to the remaining flange of the first section. A third upright was secured in the last mentioned recess to the remaining flange of the second section. Adjacent surfaces of said second and third upright members were in abutting perpendicular relationship, thereby to form an inside corner therebetween.

U.S. Pat. No. 3,286,429, patented Nov. 22, 1966, by G. D. Ratliff Jr., provided a composite wood-metal structural member, which included a top chord member, a bottom chord member spaced therefrom and a panel extending between and secured to the members. The top chord member was a flanged metal member disposed with its flange parallel to the panel and in abutting relation therewith. The flange had flexible spurs extending therefrom. The panel was impaled on the spurs, whereby, on initial loading of the beam, the resulting stress in the panel was only partially transferred to the top chore member.

U.S. Pat. No. 3,877,194, patented Apr. 15, 1975, by R. W. Matuschek et al., provided a structural corner post.

The patented corner post, which included a verticallyextending elongated column, the top and bottom surfaces of the column being flat and parallel, each of the top and bottom surfaces being divided into first and second zones. Upper and lower generally-flat end caps overlay and were secured to the first zones of the top and bottom surfaces respectively in parallel relation and extending in the same direction. End caps were provided which included vertically-aligned overhanging edge portions which formed a female receptacle with an adjacent and intermediate vertical surface on said column. The female receptacle was adapted to receive therebetween a vertical structural member. The second zones of the top and bottom surfaces overlay a laterally-extending vertical edge portion of the column which formed a male connector which was adapted for engagement with the end portions of upper and lower horizontally-extending structural members. The vertical edge portion and the intermediate vertical surface were located 90° apart. The column comprised a pair of longitudinally-extending structural elements arranged in parallel relation having the opposing longitudinal surfaces spaced slightly apart and a third longitudinally-extending structural element abutting and arranged perpendicular to the pair of structural elements. The pair and the third structural elements were of substantially-equal length. The third structural element formed the laterally-extending vertical edge portion.

U.S. Pat. No. 4,019,302, patented Apr. 26, 1977, by L. J. Meyer, provided a metal flange web connection, which included two coextensive spaced-apart parallel channel portions facing the same direction and extending the length of the member. Each of the channel portions defined a slot having parallel walls for engaging and clamping to the opposite faces of an edge portion of a plywood sheet. The walls had a large number of sharp projections extending inwardly for penetration into the plywood, thereby to form a friction bond with both faces of the plywood along the length of the channel portion. The adjacent walls of the channel portions also defined a third channel portion which was parallel to, and faced in a direction opposite from the first two channel portions.

U.S. Pat. No. 4,466,225, patented Aug. 21, 1984, by J. K. Hovind, provided a stud extender, which consisted solely of a first wide flat side, a second side, which was substantially-parallel and spaced from the first wide flat side, and a flat front, free of any elements frontward thereof. The flat front was perpendicular to, and adjoined, the two sides at substantially-square corners, all formed solely of sheet metal. At least one wide flat side had means for locating the stud extender against a wood stud with the front of the extender in a uniform-spaced parallel relationship to the front of the wood stud when the wide flat side was disposed against and extending across a minor extent of the side of the wood stud.

U.S. Pat. No. 4,619,098, patented Oct. 28, 1986, by L. H. Taylor, provided a metallic structural member, which included a hollow, generally-quadrangular in transverse cross-section stud consisting of at least three contiguous walls with the middle of the at least three walls being provided with a multiplicity of parallel, spaced, longitudinal rows of longitudinally-spaced slits, to reduce transmission of heat and sound there across and to prevent convection of air currents therethrough. Alternate rows of slits were staggered such that the longitudinal spaces of one row were positioned substantially-midway of the length of the slits of adjacent rows, thereby further reducing sound and heat transmission across at least three walls.

Canadian Patent No. 130, 742, patented Jan. 23, 1911, by S. Whitehall, provided joints for cleats, which included two members, each member having its abutting ends mitred to provide an inclined face and also a reduced end portion and a shoulder. The shoulder was diagonally opposite the reduced end portion. The latter and the shoulder of one member lay adjacent opposite edges of the inclined face of the other member.

Canadian Patent No. 266,651, patented Dec. 14, 1926, by E. A. Isaac, provided a corner lock, which included planks meeting at a desired angle. Inner and outer metal plates were bent at a corresponding angle and were provided with registering bolt holes. Bolts and nuts were provided. Kerfs were provided in the outer surfaces of the planks. Flanges on the outer plate fitted into the kerfs.

Canadian Patent No. 324,361, patented Jul. 19, 1932, by I. R. Wilson, provided a fastening means for corner frame members, which included an integral plate having substantially-right angularly extending leg portions which engaged the sides of the frame members to be braced and an integral connecting portion connecting the leg portions. Flanges were struck out from the leg portions and engaged the frame members within the plane of their joint. One flange extended from the connecting portion of the plate to lie within the plane and across the joint of the frame member. That flange was substantially-rectangular in shape and was reinforced by the connecting portion, with the free edges of the flange contacting with the sides of the frame members.

Canadian Patent No. 695,368, patented Oct. 6, 1964, by J. Conville, provided a wall partition fitting, which included a one-piece fitting having a body, with first, second, and third channels on the body. The first and second channels had outer edges and opened away from each other and lay in the plane of the second wall. Wallforming material was provided for the second wall and was in part positioned in the first and second channels. The third channel opened transversely to the direction of opening of the first and second channels. A partition wall stud was positioned in the third channel, the third channel being defined by opposed flanges, one of the flanges being secured to the first channel outer edge and the other of the flanges being secured to the second channel outer edge. Both flanges were secured to the stud. Parts of the wall-forming material for the partition wall overlay both of the flanges and was secured to the stud. The partition wall-forming material extended to the wall-forming material of the second wall completely to enclose the fitting.

Canadian Patent No. 697,320, patented Nov. 10, 1964, by H. G. Kewley, provided a joint between two members which was constructed using a retaining strip, where one or both of the parts to be joined was formed with a groove extending along the member adjacent its edge to receive a flange of the retaining strip or was provided with a shoulder or block over which the flange can engage. The joint so constructed included two members or parts which were retained in position in contact with each other by the engagement in, or with, grooves or shoulders formed in, or on, one or both of the two parts to be joined.

Canadian Patent No. 857,130, patented Dec. 1, 1970, by S. Mollinger, provided a corner connection, which included an initially-flat metal bar which was deformed so as to obtain two exterior legs, a series of main flaps with counter flaps and a series of penetrating prongs. The penetrating prongs were struck out and bent from the metal bar at a substantially-right angle thereto. The metal bar was bent at a substantially-right angle to form two exterior legs. The main flaps were struck out and bent at a substantially-right angle to one of the exterior legs at such a distance from the juncture of the legs as to allow for the thickness of one of the members to be connected. The counter flap was struck out of the main flap and was bent at an acute angle thereto at such a distance from the base of the main flap as to allow for the thickness of one of the members to be connected and to allow insertion of both members to be connected without interference with the penetrating prongs. The exterior legs and the main flaps were bent away from the projected faces of members to be connected at an angle governed by the length of the penetrating prongs.

Canadian Patent No. 858,168, patented Dec. 15, 1970, by J. M. van Ryn, provided a corner bend, which included a unitary sheet metal member having a pair of longitudinal flanges normally forming an angle therebetween of less than 90° and resiliently joined together along the apex of the angle by an integrally-formed bead portion having an arcuate surface intersected by each flange. Each flange was provided with a roughened external surface to enable a filler compound to adhere thereto. They were also provided with toothed means formed integrally of each flange and directed towards the opposite flange. The toothed means was adapted to penetrate the surface of a dry wall structural element and to engage therewith when the corner bead was applied thereto.

Canadian Patent No. 1,073,182, patented Mar. 11, 1980, by Nisbet, provided a moulded plastic corner connector, which was adapted to be removably secured by friction fit to elongated frame members for effecting a removable resilient connection therebetween. The joining member included a plurality of interconnected webs of resilient material. The webs formed a deep channel of substantially-U-shaped cross-section having spaced opposed sides joined by a relatively narrow web. The channel comprised two channel sections disposed at right angles to each other, the spaced opposed sides of the channel comprising two substantially-flat congruent L-shaped webs, the relatively narrow web joining the sides of the channel extending between the outside edges of the L-shaped webs. The sides of the channel were additionally joined by a diagonally-disposed reinforcing rib extending from the inside corners of the L-shaped webs to the outside corners thereof.

SUMMARY OF THE INVENTION (i) Aims of the Invention

In spite of the above patents, the construction industry is still faced with the problem of providing a simplified composite framing construction for buildings involving the provision of novel integrally-united nailers or nailing surfaces to which wallboard or interior sheathing may be secured which are extremely simple in construction and capable of economical manufacture and sale at a very nominal price.

It is one object of this invention substantially completely to eliminate the problem in present day corner post construction and yet to retain the structural advantages of the prior art.

Another object of this invention is to provide a lightweight corner post which may be prefabricated, yet which has sufficient strength to function properly.

Yet another object of this invention is the provision of an improved corner for interior sheathing which will not crack and open up upon settling and drying of wooden studs.

Still another object of this invention is to provide an elongated corner bar which can be used to construct both outside and intersecting corner posts.

Another object of this invention is to provide an improved partition construction.

Another object of this invention is to provide an improved construction between a partition and a wall or other partition.

(ii) Statement of Invention

This invention provides, as a first embodiment, an integral metal structural post for the erection of two pairs of interior walls, each of such pair of walls including two interior walls which are disposed at right angles to one another, the post comprising: A) a first elongate metal angle bar, the first elongate metal angle bar having an "L"-shaped cross-section, and having a first arm and a second arm which are disposed at right angles to one another, each such arm having an exterior face and an interior face, the interior face of the first arm of the first elongate metal bar having a sufficiently rough surface for gripping a tip of a self-tapping screw to cause such self-tapping screw to enter the first arm of the first elongate metal angle upon application of torque to the self-tapping screw, and the interior surface of the second arm of the first elongate metal angle bar having a sufficiently rough surface for gripping a tip of a self-tapping screw to cause such self-tapping screw to enter the second arm of the first elongate metal bar upon application of torque to the self-tapping screw; B) a second elongate metal angle bar, the second elongate metal angle bar having an "L"-shaped cross-section and having a first arm and a second arm which are disposed at right angles to one another, each such arm having an exterior face and an interior face, the interior face of the first arm of the second elongate metal angle bar having a sufficiently rough surface for gripping a tip of a self-tapping screw to cause such self-tapping screw to enter the first arm of the second elongate metal angle bar upon application of torque to the self-tapping screw, and the interior surface of the second arm of the second elongate metal angle bar having a sufficiently rough surface for gripping a tip of a self-tapping screw to cause such self-tapping screw to enter the second arm of the second elongate metal bar angle upon application of torque to the self-tapping screw; and C) an elongate web connecting the exterior face of the second arm of the first elongate metal angle bar to the exterior face of the second arm of the second elongate metal angle bar, the interior face of the first arm of the first elongate metal angle bar being separated from the interior face of the first arm of the second elongate metal angle bar by a distance providing an elongate channel therebetween, which channel is sufficient to accommodate a top plate or a bottom shoe therein, the first arm of the first elongate metal angle bar, and the first arm of the second elongate metal angle bar each being provided with respective, inwardly-facing, centrally-oriented flanges, each such flange commencing at a region which is spaced from the top of the respective elongate metal angle bar and terminating at a region which is spaced from the bottom of the respective elongate metal angle bar; wherein the first arm of the first elongate metal bar thus has means for securing a first interior wallboard or interior sheathing directly to the interior face of the first arm of the first elongate metal angle bar by means of self-tapping screws, and the second arm of the first elongate metal bar thus has means for securing a second interior wallboard or interior sheathing directly to the interior face of the second arm of the first elongated metal bar by means of self-tapping screws, the second interior wallboard or interior sheathing being securable at right angles to the first interior wallboard or interior sheathing; and wherein the first arm of the second elongate metal angle bar thus has means for securing a third interior wallboard or interior sheathing directly to the interior face of the first arm of the second elongate metal angle bar by means of self-tapping screws, and the second arm of the second elongate metal bar thus has means for securing a fourth interior wallboard or interior sheathing directly to the second arm of the second elongate metal angle bar by means of self-tapping screws, the fourth interior wallboard or interior sheathing being securable at right angles to the third interior wallboard or interior sheathing.

In a second embodiment, the present invention also provides two interior corners consisting of two pairs of interior walls, each of the pair of interior walls including two walls which are disposed at right angles to one another, such interior comers comprising: (I) a metal structural post which itself comprises the combination of: (A) a first elongate metal angle bar, the first elongate metal angle bar having an "L"-shaped cross-section, and having a first arm and a second arm which are disposed at right angles to one another, each such arm having an exterior face and an interior face, the interior face of the first arm of the first elongate metal bar having a sufficiently rough surface for gripping a tip of a self-tapping screw to cause such self-tapping screw to enter the first arm of the first elongate metal bar angle upon application of torque to the self-tapping screw, and the interior surface of the second arm of the first elongate metal angle bar having a sufficiently rough surface for gripping a tip of a self-tapping screw to cause such self-tapping screw to enter the second arm of the first elongate metal bar upon application of torque to the self-tapping screw; B) a second elongate metal angle bar, the second elongate metal angle bar having an "L"-shaped cross-section, and having a first arm and a second arm which are disposed at right angles to one another, each such arm having an exterior face and an interior face, the interior face of the first arm of the second elongate metal angle bar having a sufficiently rough surface for gripping a tip of a self-tapping screw to cause such self-tapping screw to enter the first arm of the second elongate metal angle bar upon application of torque to such self-tapping screw, and the second arm of the second elongate metal angle bar having a sufficiently rough surface for gripping a tip of a self-tapping screw to cause such self-tapping screw to enter the second arm of the second elongate metal bar angle upon application of torque to such self-tapping screw; and C) an elongate web connecting the exterior face of the second arm of the first elongate metal angle bar to the exterior face of the second arm of the second elongate metal angle bar, the interior face of the first arm of the first elongate metal angle bar being separated from the interior face of the first arm of the second elongate metal angle bar by a distance providing an elongate channel therebetween, which channel is sufficient to accommodate a top plate or a bottom shoe therein, the first arm of the first elongate metal angle bar and the first arm of the second elongate metal angle bar each being provided with respective, inwardly-facing, centrally-oriented flanges, each such flange commencing at a region which is spaced from the top of the respective elongate metal angle bar and terminating at a region which is spaced from the bottom of the respective elongate metal angle bar; (II) a top plate which is disposed in the elongate channel and is secured to the inner face of the first arm of the first elongate metal angle bar, and to the inner face of the first arm of the second elongate metal angle bar at right angles to the elongate web at the top of the post, above the flanges; (III) a bottom shoe which is disposed in the elongate channel and is secured to the inner face of the first arm of the first elongate metal angle bar, and to the inner face of the first arm of the second elongate metal angle bar at right angles to the elongate web at the bottom of the post; (IV) a first interior wallboard or interior sheathing which is secured directly to the interior face of the first arm of the first elongate metal angle bar by means of self-tapping screws, and a second interior wallboard or interior sheathing which is secured directly to the interior face of the second arm of the second elongated metal bar by means of the self-tapping screws, the second interior wallboard or interior sheathing being secured at right angles to the first interior wallboard or interior sheathing, thereby to provide one interior comer; and (V) a third interior wallboard or interior sheathing which is secured directly to the interior face of the first arm of the second elongate metal angle bar by means of self-tapping screws, and a fourth interior wallboard or interior sheathing which is secured directly to the interior face of the second arm of the second elongate metal angle bar by means of self-tapping screws, the fourth interior wallboard or interior sheathing being secured at right angles to the third interior wallboard or interior sheathing, thereby to provide a second corner.

(iii) Other Features of the Invention

In respect of the first embodiment, the structural post includes a top plate which is disposed within the channel and is secured to the inner face of the first arm of the first elongate metal angle bar and to the inner face of the first arm of the second elongate metal angle bar at right angles to the elongate web at the top of the post, above the flanges, and a bottom shoe which is disposed within the channel and is secured to the inner face of the first arm of the first elongate metal angle bar and to the inner face of the first arm of the second elongate metal angle bar at right angles to the elongate web at the bottom of the post.

By one feature thereof, the top plate and the shoe are each made of wood, and by another variation thereof, the top plate and shoe are each made of "U"-cross-section metal.

In respect of the second embodiment, by one feature thereof, the top plate and the bottom shoe are each rectangular wooden members; or, by another feature thereof, the top plate and the bottom shoe are each U-shaped metal members.

BRIEF DESCRIPTION OF THE DRAWINGS

In the accompanying drawings.

Figure 1A:
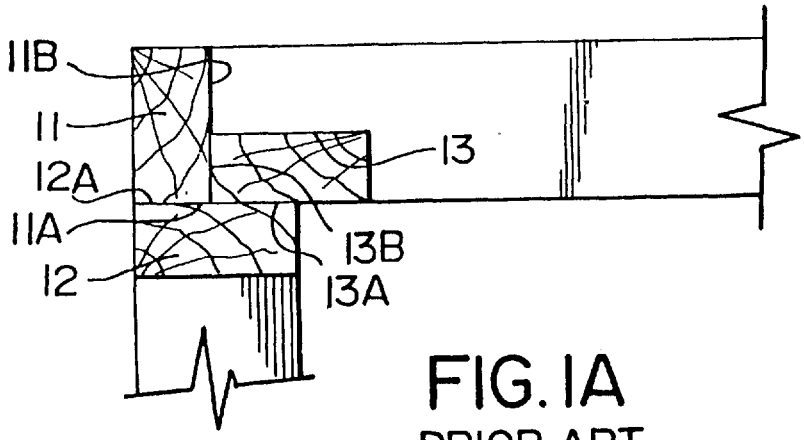
FIG. 1A PRIOR ART
FIGS. 1A, 1B and 1C are plan views of typical conventional prior art wood framing.
Figure 1B:
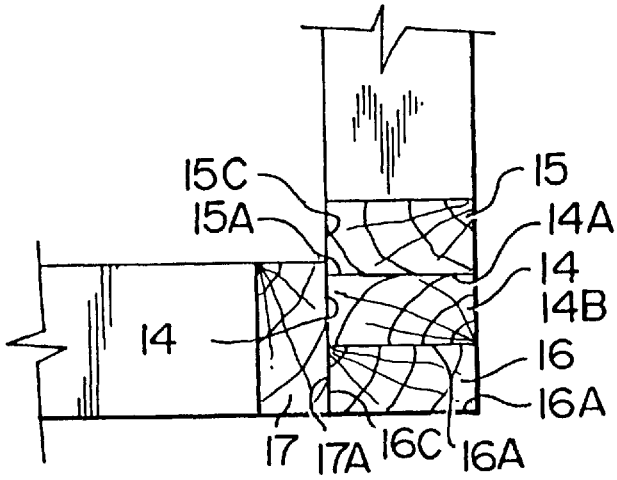
FIG. 1B PRIOR ART
Figure 1C:
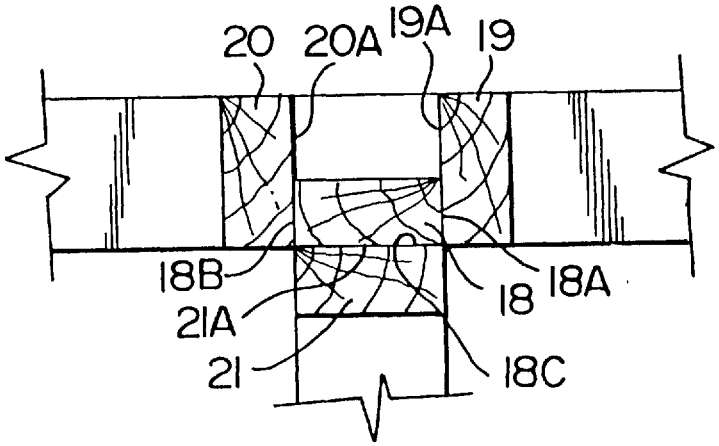
FIG. 1C PRIOR ART

DESCRIPTION OF PREFERRED EMBODIMENTS (i) Description of FIGS. 1A, 1B and 1C (Prior Art)

As seen in FIGS. 1A, 1B, and 1C, three types of conventional prior art corner constructions are shown. The ordinary way to assemble corner posts has been to secure studs together to make a solid post. In FIG. 1A, an interior prior art corner post construction is provided by a first stud 11, which has its end edge 11A butted against a face 12A of a second stud 12. A third stud 13 is lapped in face-to-face contact, i.e., face 13A in contact with face 12*a* of the second stud 12 and has its end edge 13B butted against face 11B of the first stud 11.

In FIG. 1B, an exterior prior art corner post construction is provided by a first (central) corner stud 14, which is butted exteriorly at one of its faces 14A by face 15A of a second corner stud 15, and at its other face 14B by face 16A of a third corner stud 16. A fourth corner stud 17 is butted with one of its side faces 17A against the end edges 14C of the first corner stud 14, and end edges 16C of the third corner stud 16 and end edges 15C of the second corner stud 15.

In FIG. IC, an interior prior art partition wall post structure is provided which includes a first main wall stud 18, which is butted at one side edge 18A by a face 19A of a second wall stud 19 and at its other side edge 18B by a face 20A of a third wall stud 20. A fourth partition stud 21 is butted with its face 21A against face 18C of the first wall stud 18.

The studs are normally 2×3's, 2×4's or 2×6's, and, as seen above, at least three pieces are needed to construct a corner post. As seen, the outside corner posts are generally made of three pieces and intersecting corner posts are made of three or four pieces. This type of construction uses a considerable amount of lumber and more important it is time consuming. These factors are especially significant because they directly affect the cost of building.

Studs which are provided for the construction of composite structural corner posts according to embodiments of the present invention will now be described with reference to FIGS. 2–5.

Figure 2:
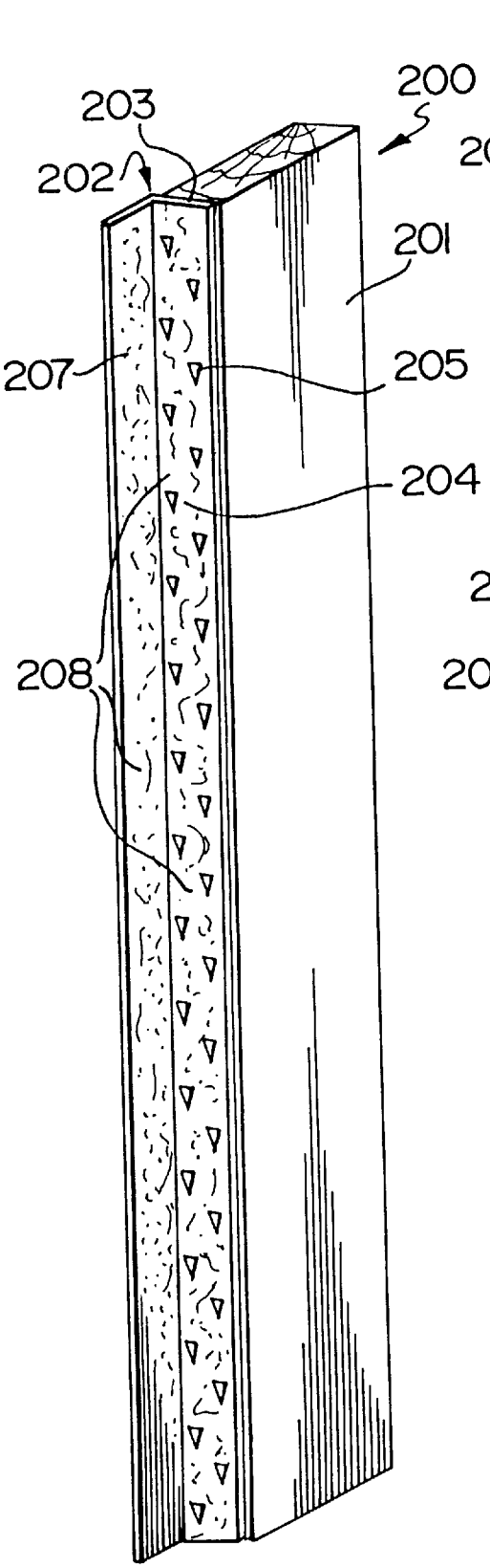
FIG. 2 is a perspective view of a composite wood "L"-metal elongated angle bar stud forming an essential part of one embodiment of this invention.

(ii) Description of FIG. 2

As seen in FIG. 2, a composite post 200 includes a rectangular wooden stud 201, which includes an elongated angle bar 202 having an "L"-shaped cross-section secured to one side edge 203 thereof. One leg 204 of the metal elongated angle bar 202 is provided with a plurality of vertically-spaced-apart, pointed, punched-out teeth 205, whereby an elongated angle bar 202 is secured to side edge 203 of the wooden stud 201. Leg 204 is provided with a roughened surface 208 to enable screws to be secured thereto in a self-tapping fashion. The other leg 207 is free and unsecured and projects from the stud 201, and is also provided with a roughened surface 208 to enable screws to be secured thereto in a self-tapping fashion. The roughened surfaces 208 facilitate securing interior sheathing to the composite stud by means of screws.

Figure 3:
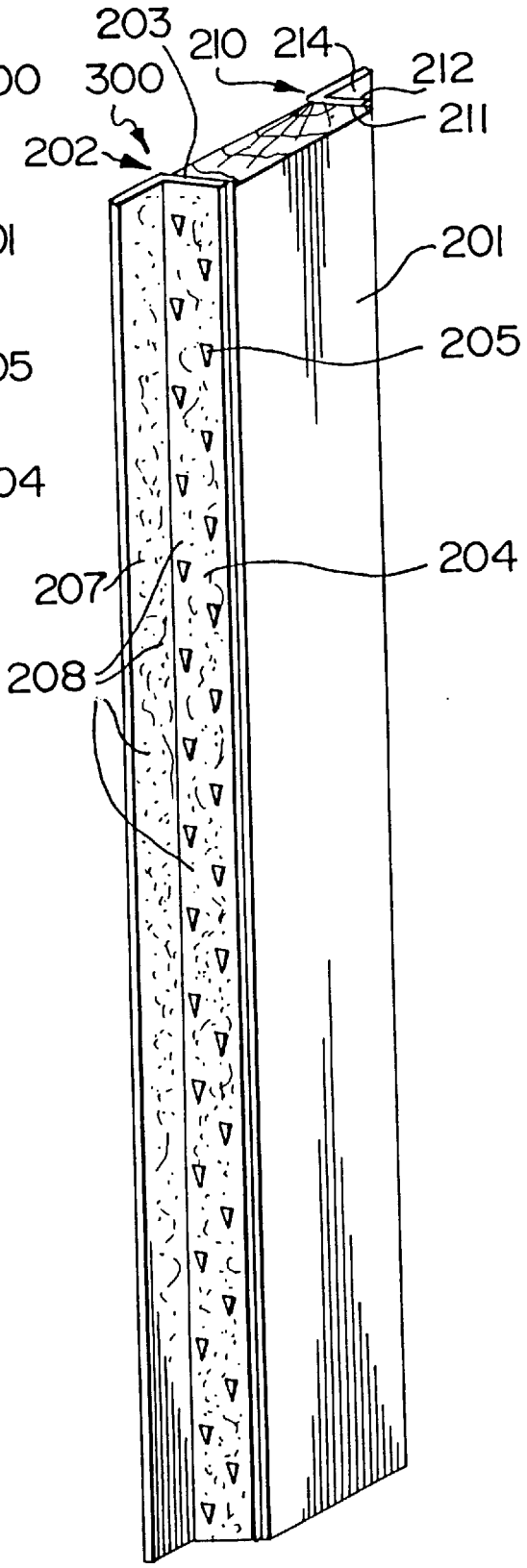
FIG. 3 is a perspective view of a composite wood/two "L"-metal elongated angle bars stud forming an essential part of another embodiment of this invention.

(iii) Description of FIG. 3

As seen in FIG. 3, a composite post 300 includes a wooden stud 201, which includes a metal (e.g., steel) elongated angle bar 202 having an "L"-shaped cross-section secured to one side edge 203 thereof. One leg 204 of the metal elongated angle bar 202 is provided with a plurality of vertically-spaced-apart, pointed, punched-out teeth 205, whereby an elongated angle bar 202 is secured to side edge 203 of the wooden stud 201. Leg 204 is provided with a roughened surface 208 to enable screws to be secured thereto in a self-tapping fashion. The other leg 207 is free and unsecured and projects from the stud 201, and is also provided with a roughened surface 208 to enable screws to be secured there to in a self-tapping fashion. The roughened surfaces 208 facilitate securing interior sheathing to the composite stud by means of screws.

As part of composite post 300, rectangular wooden stud 201 also includes a second metal (e.g., steel) elongated angle bar 210 having an "L"-shaped cross-section secured to another side edge 211 thereof which is parallel to side edge 203. One leg 212 of the second metal elongated angle bar 210 is provided with a plurality of vertically-spaced-apart, pointed, punched-out teeth (not seen), whereby the second elongated metal angle bar 210 is secured to side edge 211 of the wooden stud 201. Leg 212 is provided with a roughened surface (not seen) to enable screws to be secured thereto in a self-tapping fashion. The other leg 214 is free and unsecured and projects from stud 201, and is also provided with a roughened surface (not seen) to enable screws to be secured thereto in a self-tapping fashion. The roughened surfaces facilitate securing interior sheathing to the composite stud by means of screws.

Figure 4:
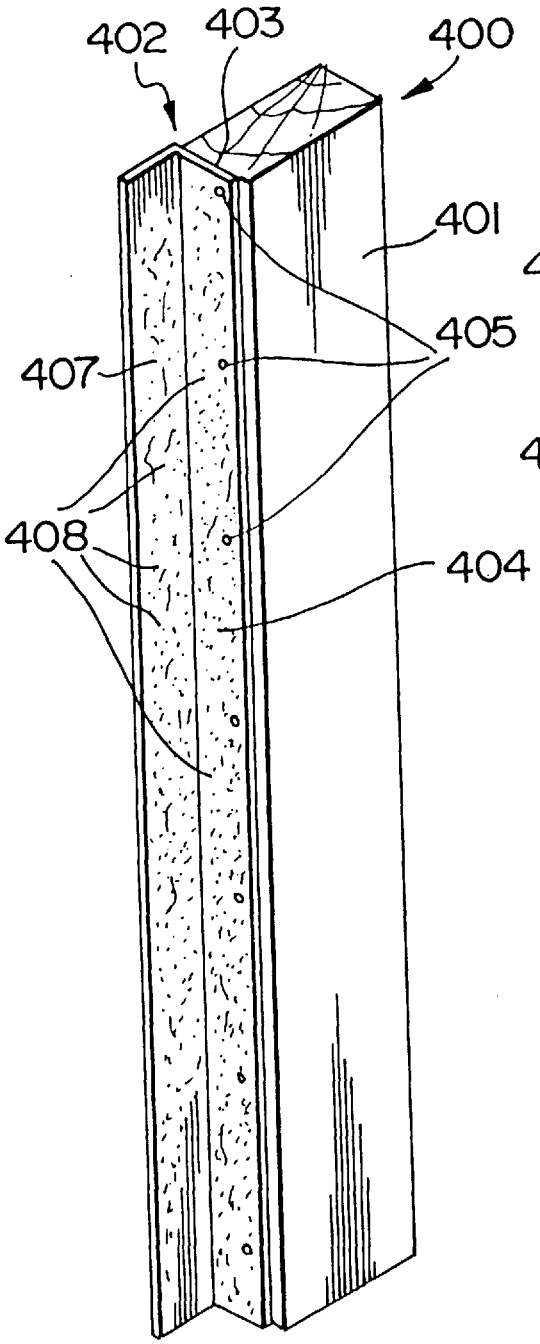
FIG. 4 is a perspective view of a composite wood/"L"-metal elongated angle bar stud forming an essential part of still another embodiment of this invention.

(iv) Description of FIG. 4

As seen in FIG. 4, a composite post 400 includes a wooden stud 401, and one elongated angle bar 402 having an "L"-shaped cross-section. Elongated metal angle bar 402 is secured to one side face 403 of stud face 401. One leg 404 of the metal elongated angle bar 402 is provided with a plurality of vertically-spaced-apart nailing apertures 405, whereby the elongated metal angle bar 402 may be secured (as by nails, screws, etc.) to the side face 403 of the wooden stud 401. Leg 404 is provided with a roughened surface 408 to enable screws to be secured thereto in a self-tapping fashion. The other leg 407 is free and unsecured and projects from stud 401, and is also provided with a roughened surface 408 to enable screws to be secured thereto in a self-tapping fashion. The roughened surfaces 408 facilitate securing interior sheathing to the composite stud by means of screws.

Figure 5:
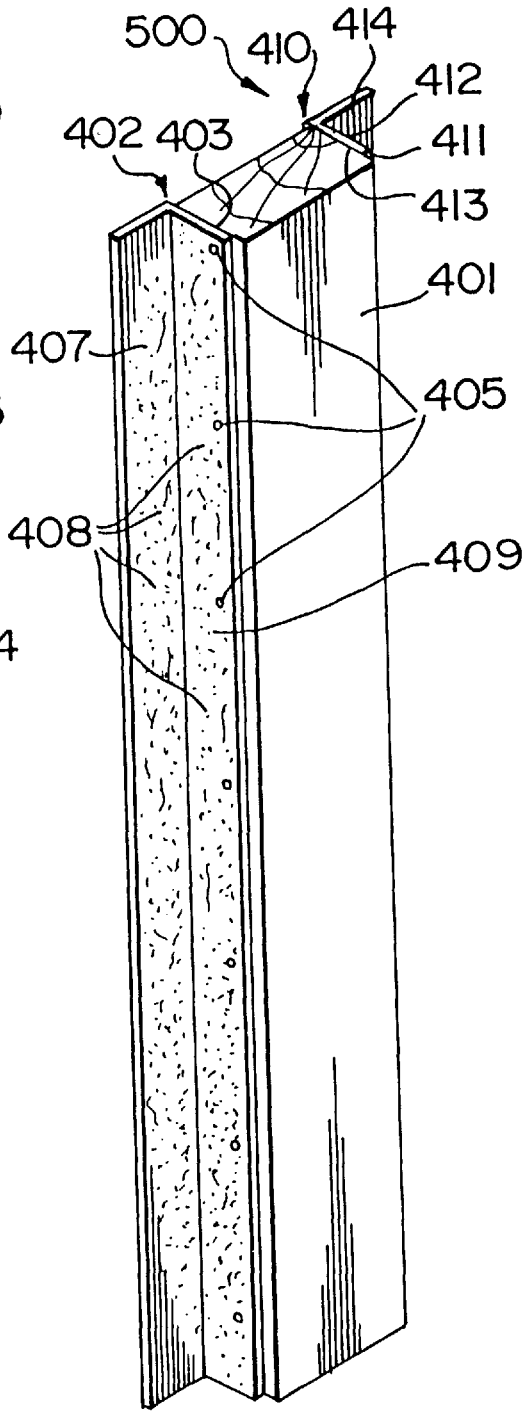
FIG. 5 is a perspective view of a wood/two "L"-metal elongated angle bars stud forming an essential part of still another embodiment of this invention.

(v) Description of FIG. 5

As seen in FIG. 5, a composite post 500 includes a rectangular wooden stud 401, and two opposed elongated angle bars 402 having an "L"-shaped cross-section, 410 having a "L"-shaped cross-section. One leg 404 of the "L"-elongated metal angle bar 402 is provided with a plurality of vertically-spaced-apart nailing apertures 409, whereby the elongated metal angle bar 402 is secured (as by nails, screws, etc.) to the side face 403 of the wooden stud 401. Leg 404 is provided with a roughened surface 408 to enable screws to be secured thereto in a self-tapping fashion. The other leg 407 is free and unsecured and projects from stud 401, and is also provided with a roughened surface 408 to enable screws to be secured thereto in a self-tapping fashion. The roughened surfaces 408 facilitate securing interior sheathing to the composite stud by means of screws.

As part of composite post 500, rectangular wooden stud 401 also includes a second "L"-metal (e.g., steel) elongated angle bar 410 having an "L"-shaped cross-section. Second elongated metal angle bar 410 is secured to one side edge 413 of stud 401. One leg 411 of the second "L"-elongated metal angle bar 410 is provided with a plurality of vertically-spaced-apart nailing apertures (not seen), whereby the elongated metal angle bar 410 is secured (as by nails, screws, etc.) to the side face 413 of the wooden stud 401. Leg 411 is provided with a roughened surface (not seen) to enable screws to be secured thereto in a self-tapping fashion. The other leg 412 is free and unsecured and which projects from stud 401, and is also provided with a roughened surface (not seen) to enable screws to be secured thereto in a self-tapping fashion. The roughened surfaces facilitate securing interior sheathing to the composite stud by means of screws.

Figure 6A:
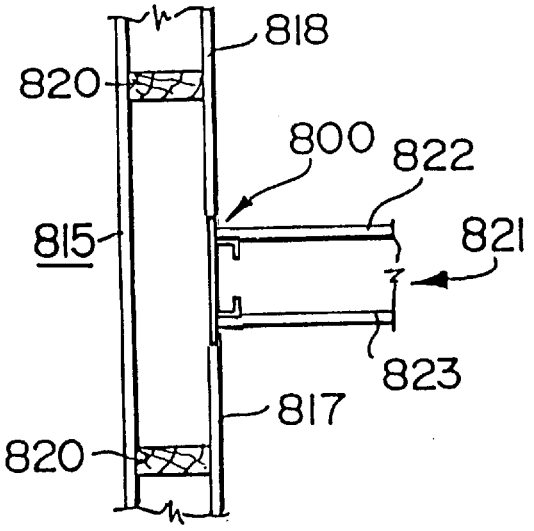
FIG. 6 and FIG. 6A are a perspective and a top plan view respectively of a metal elongated structural post in the combination with one wooden top plate and one bottom shoe as an essential part of yet another embodiment of this invention.
Figure 6:
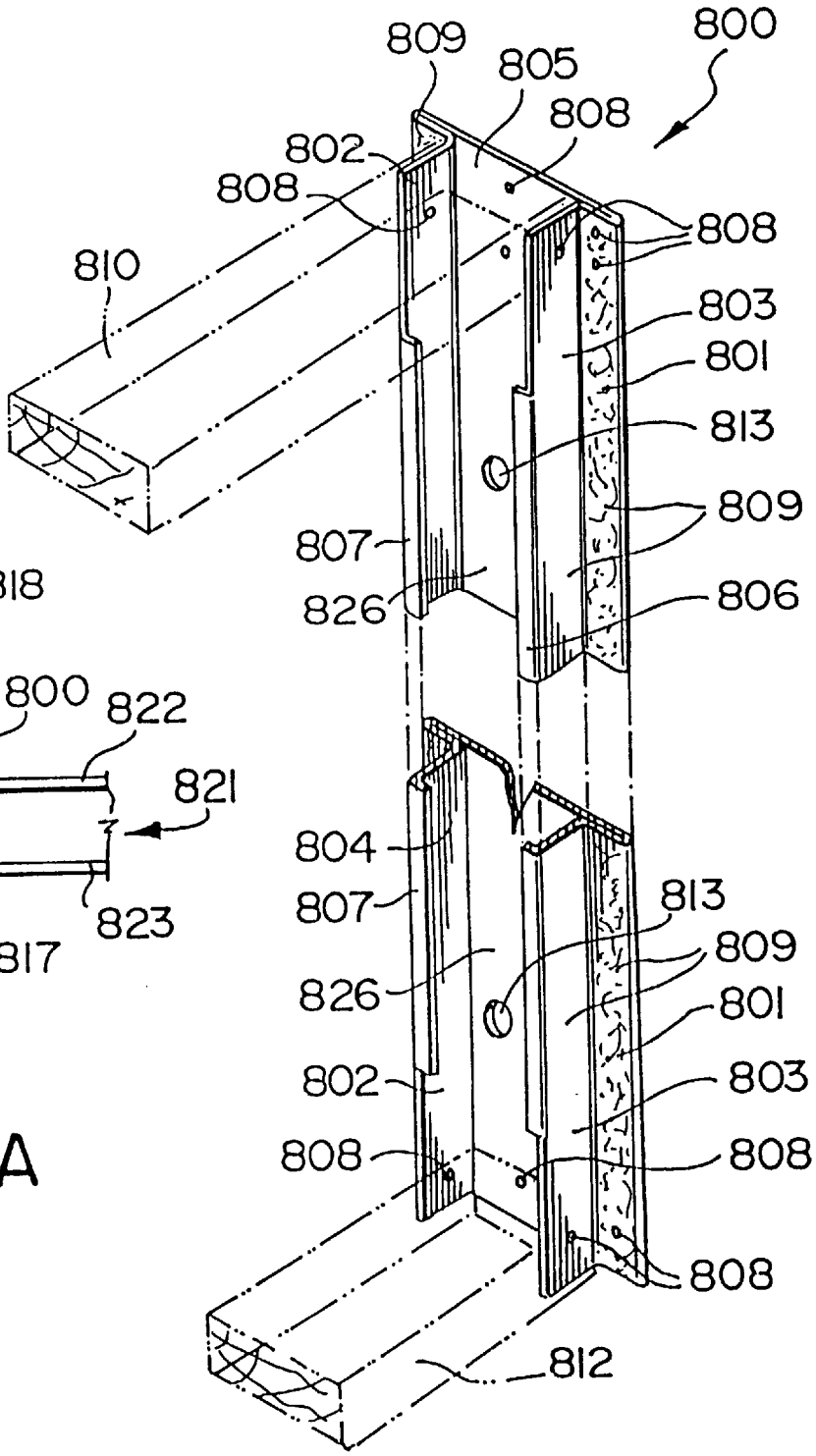

(vi) Description of FIG. 6

As seen in FIG. 6, a metal post 800 includes a pair of metal elongated angle bars each having an "L"-shaped cross-section including legs 801, 802, arms 803, 804 which are folded over at 180° to be interconnected by a flat web 805 to provide a channel 826 between legs 801, 802 and web 805. Legs 801, 802 are each provided with respective inwardly-facing, centrally-oriented flanges 806, 807. The flanges 806, 807 commence at a region spaced from the top and terminate at a region spaced from the bottom. Legs 802 and 803, and 804 are provided with upper and lower apertures 808. All legs 801, 802, 803, 825 are provided with a roughened surface to enable screws to be secured thereto in a self-tapping fashion. The roughened surfaces 809 facilitate securing interior sheathing to the composite stud by means of screws. The flat web 805 is provided with apertures filled with hollow cylindrical plugs 813 in order to be able to fish electrical or telephone wires therethrough.

FIG. 6 also shows the manner in which an upper wooden plate 810 and one bottom wooden shoe 812 are secured to the composite metal elongated angle bar 800.

FIG. 6A shows how the bar 800 is used.

As seen, a wall 815 which may be an inside partition wall or an outside wall, includes a plurality of upright studs 820 covered by sheathing 817, 818. A partition wall 821 is erected using metal post 800 providing one element of the present invention.

Sheathing 818 is secured to leg 801 and sheathing 817 is secured to leg 804. Sheathing 823 (forming wall 821) is secured to let 803, and sheathing 823 (forming wall 821) is secured to leg 802.

Figure 7A:
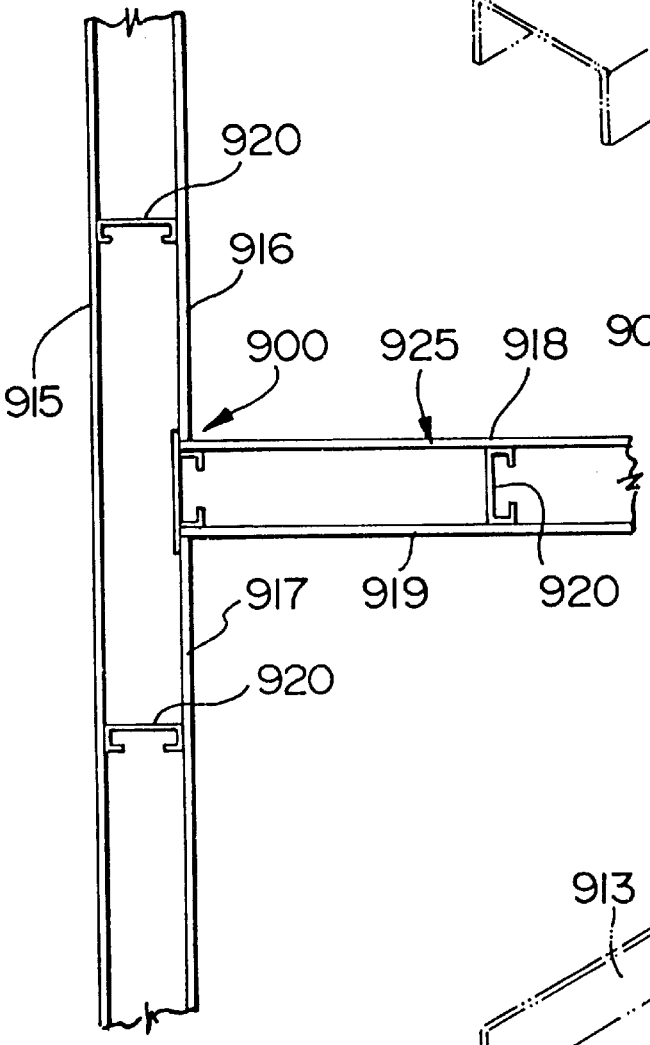
FIG. 7 and FIG. 7A are a perspective and a top plan view respectively of a metal elongated structural post in the combination with a metal top plate and a metal bottom shoe as an essential part of still another embodiment of this invention.
Figure 7:
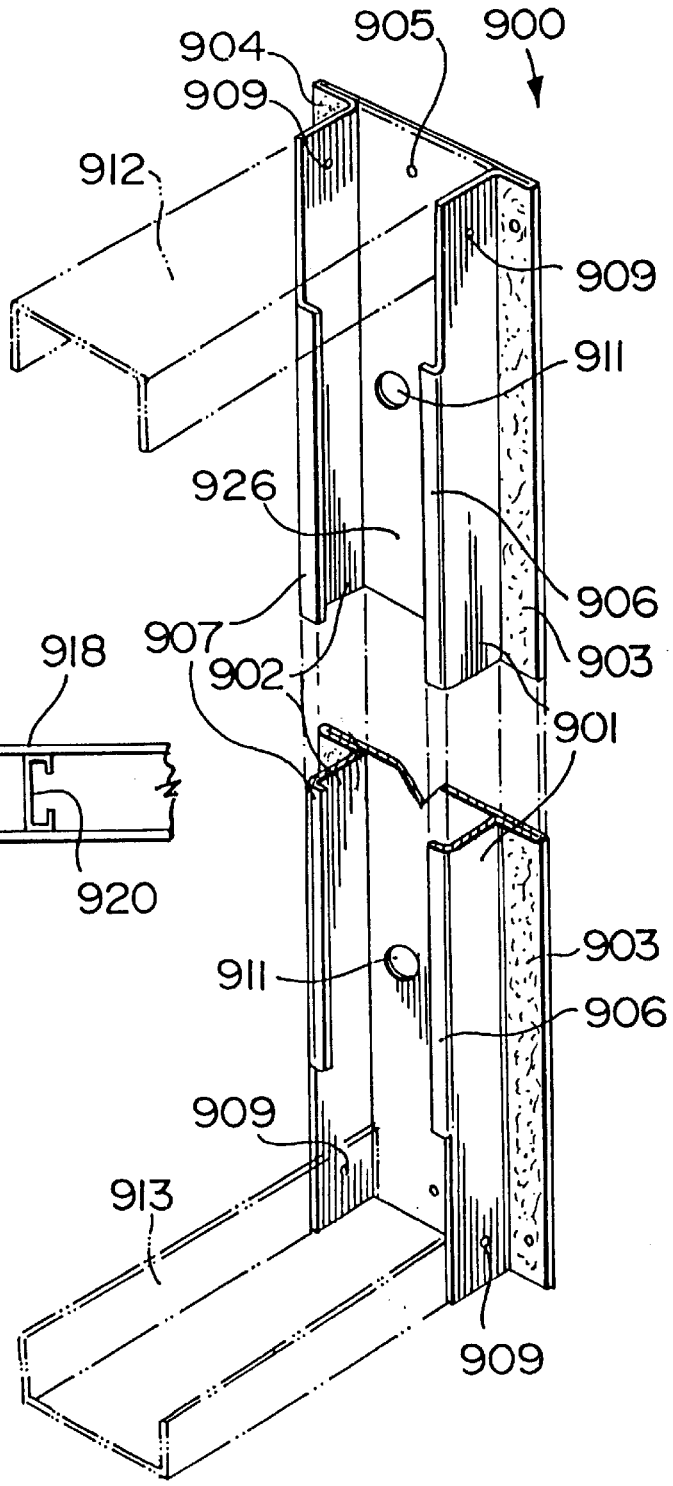

(vii) Description of FIG. 7

As seen in FIG. 7, a metal post 900 includes a pair of elongated metal angle bars each having an "L"-shaped cross-section including legs 901, 902, 903, and 904, legs 903, 904 being folded over by 180° to provide interconnecting elongate flat web 905 to provide a channel 906 between legs 901, 902 and web 904. Legs 901, 902 are each provided with respective inwardly-facing, centrally-oriented flanges 906, 907. The flanges 906, 907 commence at a region spaced from the top and terminate at a region spaced from the bottom. Legs 901, 902, are provided with upper and lower apertures 909. Each of legs 901, 902, 903, 904 is provided with a roughened surface to enable screws to be secured thereto in a self-tapping fashion. Web 905 is provided with a plurality of apertures 911 to enable electrical or telephone wires to be fished therethrough. The roughened surface facilitates securing interior sheathing to the composite stud by means of screws.

FIG. 7 also shows the manner in which an upper metal plate 912 and a bottom metal shoe 913 are secured to the metal post 900 through apertures 909

FIG. 7A shows how the metal post 900 is used. As seen, a wall 915 which may be an inside partition wall or an outside wall, includes a plurality of metal studs 920 covered by sheathing 916, 917. A partition wall 925 is erected using metal post 900 providing one element of the present invention, and metal studs 920. Sheathing 916 is secured to leg 903 and sheathing 917 is secured to 904. Sheathing 919 (forming wall 825) is secured to leg 901 and sheathing 919 (forming wall 825) is secured to leg 902.

Figures 8, 8A, 8B:
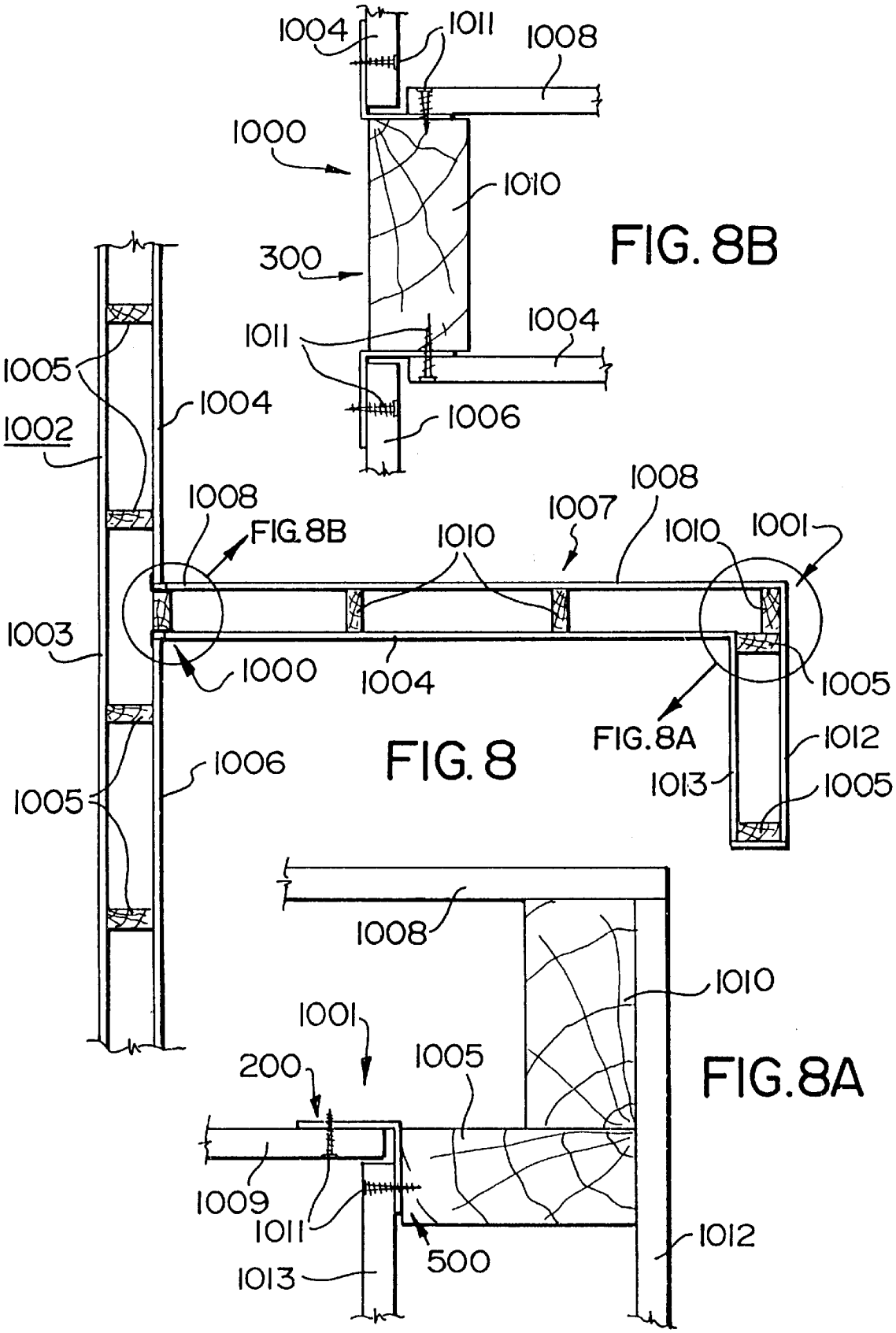
FIG. 8 (including enlarged inset FIG. 8A and FIG. 8B) is a plan view of a framing system according to one embodiment of the invention using composite "L"-metal elongated angle bar corners of another embodiment of this invention.

(viii) Description of FIG. 8, FIG. 8A and FIG. 8B

FIG. 8, FIG. 8A and FIG. 8B show the framing for a partition wall which includes an inner aspect 1000 of an inner corner (see FIG. 10B) and an inner aspect 1001 of an outside corner (see FIG. 1OA). As seen, a wall 1002 which may be an inside partition wall or an outside wall, includes a plurality of upright studs 1005, covered by sheathing 1003, 1004, 1006. A partition wall 1007 is erected using studs 300, 500, 800, or 900, providing one element of the present invention. For simplicity, FIG. 10B shows the use of stud 300. The area of joining of the wall 1002 with the wall 1007 is provided, as noted above, by composite stud 300, i.e., wooden stud 201 and two elongated metal angle bars 202, 210 as previously described. Sheathing 1004, 1100, are secured to the free and unsecured and which projects secured legs 207, 214, while sheathing 1008, 1004 are secured to secured legs 204, 212 of elongated metal angle bar 300 by means of screws 1011.

As noted above, while elongated metal angle stud 300 has been described as being used, it is possible, of course, to use elongated metal angle studs 500, 700, 800 or 900.

The partition wall 1007 includes a plurality of spaced-apart vertical studs 1010, covered with sheathing 1007, 1008. Exterior corner 1001 is provided by composite stud 200 secured to a conventional outside corner stud 1010. Sheathing 1009 is secured to the unsecured leg 207 of elongated metal angle stud 200, while sheathing 1013 is secured to the secured leg 204 of elongated metal angle bar 200 by screws 1011, while, for simplicity composite stud 200 has been described as being used, other composite studs 400 or 600 of other embodiments of this invention may be used. Exterior sheathing 1008 and 1012 are secured to conventional stud 1010.

Figures 9, 9A, 9B:
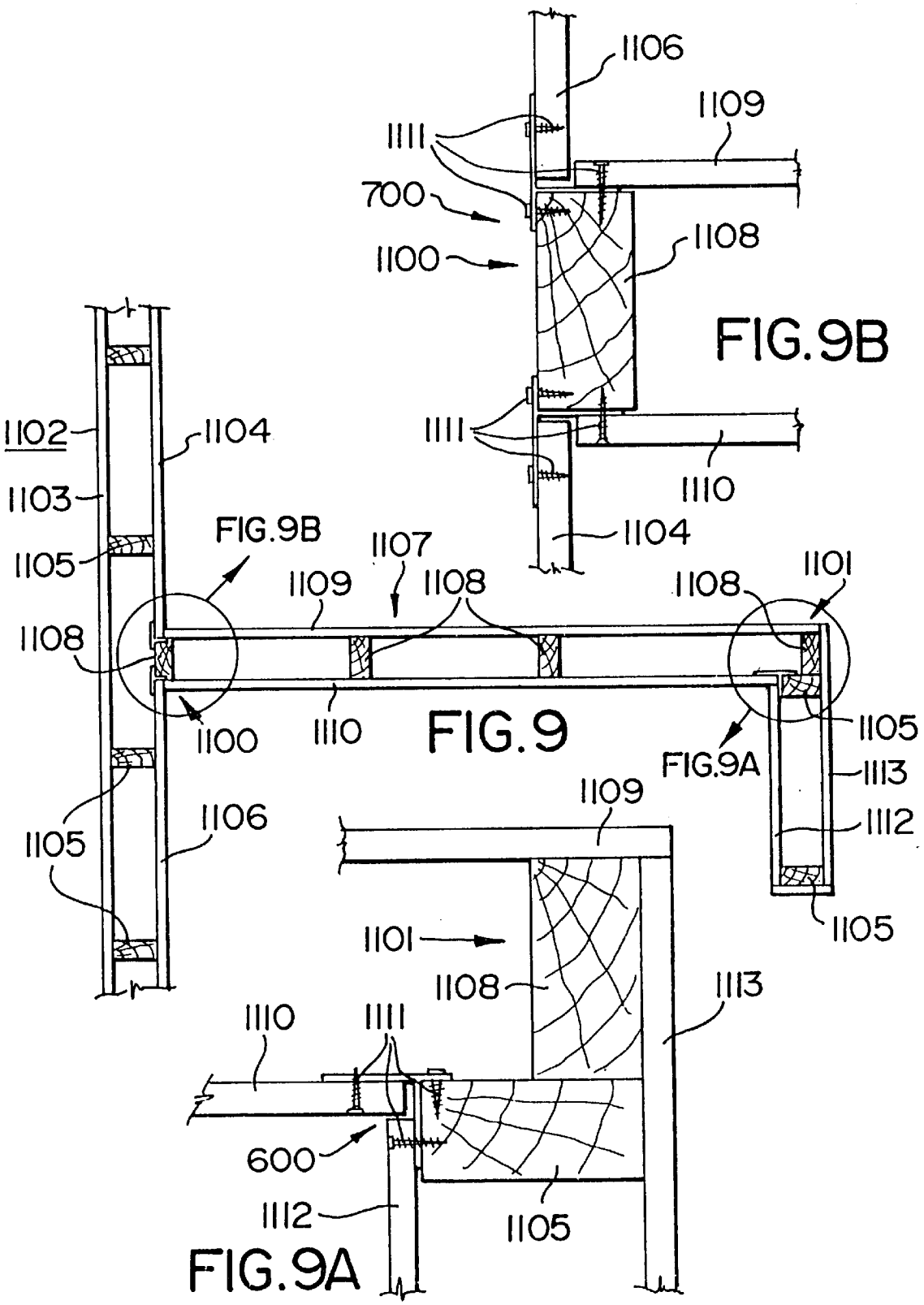
FIG. 9 is a plan view (including enlarged inset FIG. 9A and FIG. 9B) of a framing system according to another embodiment of this invention using composite "T"-metal elongated angle bar corners of another embodiment of this invention.

(ix) Description of FIG. 9, FIG. 9A and FIG. 9B

FIG. 9, FIG. 9A and FIG. 9B show the framing for a partition wall which includes an inner corner 1100, (see FIG. 9B) and an inner aspect of an outside corner 1101 (see FIG. 9A). As seen, a wall 1102 includes a plurality of upright studs 1105, covered by sheathing 1103, 1104, 1106. A partition wall 1107 is erected using the composite studs providing alternative embodiments of the present invention, i.e., 700, 800, or 900. For simplicity FIG. 11*b* shows the use of stud 300. FIG. 11B shows the use of stud 700. The area of joining of a wall 1102 with a partition wall 1107 is provided as noted above by composite "T"-stud 700, i.e., wooden stud 601 and two elongated metal angle bars 602, 616. The partition wall 1107 includes a plurality of spaced-apart vertical studs 1108, covered with sheathing 1109, 1110. Sheathing 1004 is secured to the unsecured leg 607 of elongated metal angle bar 700 and sheathing 1106 is secured to the unsecured leg 612 of the elongated metal angle bar 700. Wall 1109 is secured to the secured leg 604 of the elongated metal angle composite 700, and wall 1110 is secured to the secured leg 604 of the elongated metal angle bar 700, all by screws 1111.

The exterior corner is provided by composite stud 600 secured to a conventional stud 1108. Sheathing 1109 is secured to the unsecured leg 607 of elongated metal angle bar 600, while sheathing 1112 is secured to the secured leg 604 of elongated metal angle bar 600, all by screws 1111. Exterior sheathing 1109, 1113 is secured to conventional stud 1108.

Figure 10:
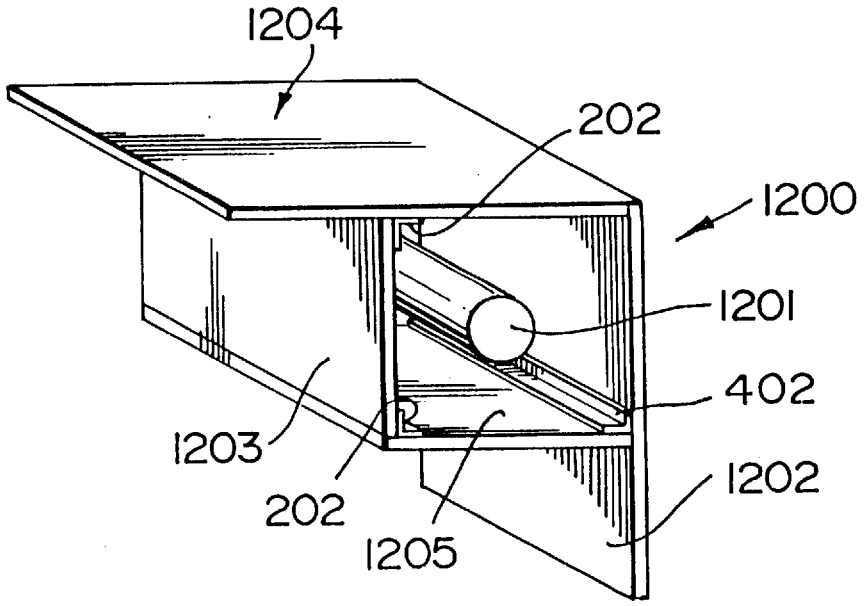
FIG. 10 is a perspective view of a box structure including a plurality of "L"-shaped elongated angle bar corners to provide yet another embodiment of this invention.

(x) Description of FIG. 10

FIG. 10 shows the construction of a box 1200 around a duct 1201. The box 1200 is defined by outside corner walls 1202, 1204. One inner box wall 1203 is secured at one edge to elongated corner angle bar 202 or 402 which is secured to wall 1202 and at the other edge by another elongated corner angle bar 202 or 402. The other inner box wall 1205 is secured at one edge to one elongated corner angle bar 202, or 402 which is secured to wall 1202 and at the other edge to a further elongated corner angle bar 202, or 402 which is secured to wall 1203.

Figure 11:
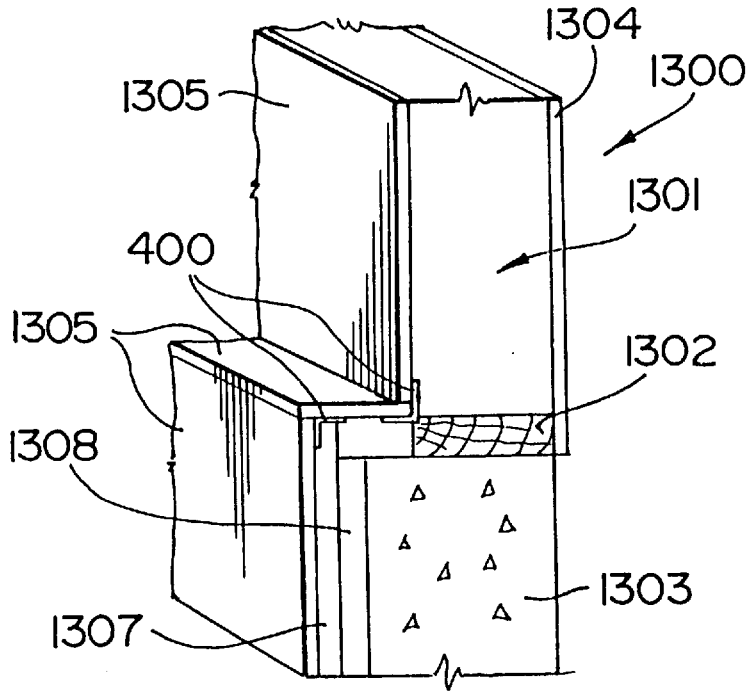
FIG. 11 is a perspective view of an insulating structure including a plurality of "L"-shaped elongated angle bar corners to provide still another embodiment of this invention.

(xi) Description of FIG. 11

FIG. 11, shows an insulated basement wall structure 1300. Concrete wall 1303 is provided with a framed knee wall of wooden or metal members and defined by a shoe 1302 and a series of studs 1301. The studs 1301 are covered on the exterior side of the wall with a conventional sheathing 1304 and on the interior with wallboard sheathing 1305. STYROFOAM™ (or similar product) insulating sheets 1308 are placed against the interior side of the concrete wall and wooden or metal furring straps 1307 are placed into vertical channels, manufactured for that purpose, in the surface of the STYROFOAM™ and nails or screws are fixed through the furring straps and the STYROFOAM™ into the concrete wall 1303, thus securing the furring straps and STYROFOAM™ sheets to the concrete wall 1303. The wooden or metal furring straps thus fastened and fixed provide a nailer surface to which wallboard 1305 can be fastened by nails or screws.

The first metal angle bar (200 or 400) is fastened with nails or screws to the top of the vertical furring straps on the one corner and the second metal angle bar is fastened with nails or screws on the other corner to the interior side edges of the studs 1301. These metal angle bar provide surfaces to which the vertical and horizontal wallboards 1305 are fastened with screws and thus a junction is formed which will tend to prevent cracking, splitting and separating of the wall-board junctions as the wooden members of the wall dry, twist, warp, shrink and settle.

Figure 12:
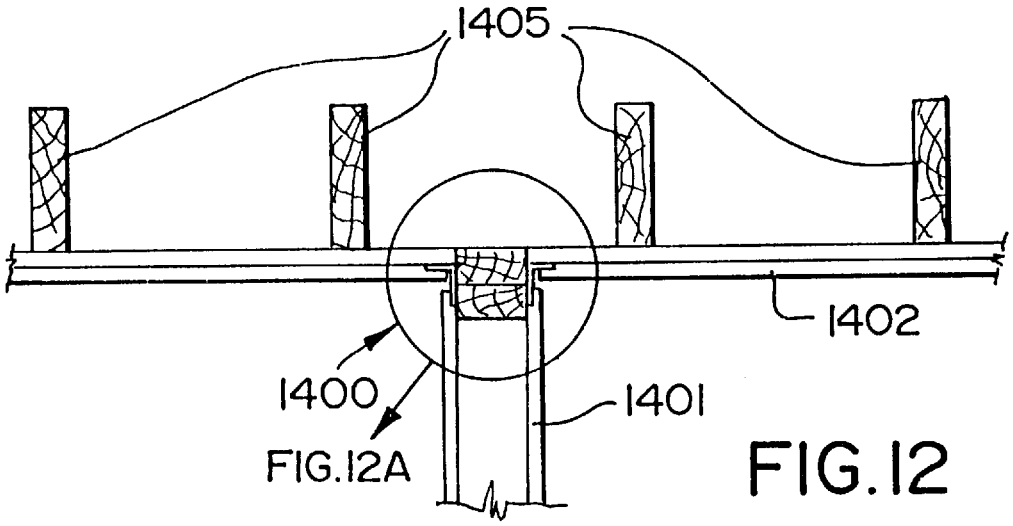
FIG. 12 and FIG. 12A are plan views of a partition wall and ceiling structure including a plurality of "L" metal angle bar corners to provide still another embodiment of this invention.
Figure 12A:
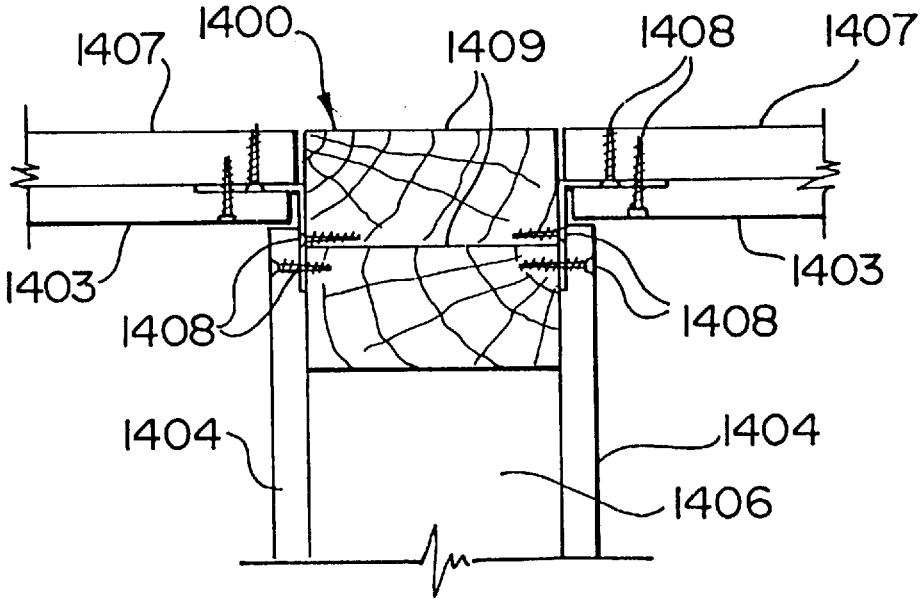

(xii) Description of FIG. 12 and FIG. 12A

FIG. 12 and FIG. 12A show plan views of the junction 1400 of the structure of a framed partition wall and the structure of a framed ceiling, whereby the partition wall 1401 intersects the ceiling 1402 at right angles. Partition wallboard 1404, secured to either side of the partition wall 1401, intersects ceiling wallboard 1403 at right angles.

A partition is formed from a series of metal or wooden studs (shown as 1406 in FIG. 12A) secured perpendicularly to a single or double top plate (shown as 1409 in FIG. 12A). The ceiling is formed from a series of parallel floor joists 1405 to which wooden or metal straps 1403 are fastened. A variation of the ceiling structure is formed by a series of parallel lower chords or members of manufactured roof trusses.

By securing one arm of the metal angle bar to the straps 1407 and the other arm, which is at right angles to the first arm, to the side edge of the top plate 1409, a nailer surface is thus provided by the first arm to which the ceiling wallboard 1403 is fastened by screws 1408 and a second nailer surface is provided by the second arm of the metal angle bar corner to which the wallboard 1404 is fastened by screws 1408, thus providing a junction which is ready for filler and finishing.

A problem which has been identified in the construction industry is the cracking, splitting and separating of finished wallboard joints and corners at the junction of partition and ceiling wallboard typified by junction 1400. This problem results from drying, twisting, shrinking and warping of the wooden members used in frame construction and also results, in the case of a ceiling structure formed by the lower chords or members of manufactured roof trusses, from the lifting of the roof truss in various weather conditions. The object of this invention is to reduce or eliminate the cracking, splitting and separating of the wallboard corners.

A second anticipated benefit of this invention is the substantial reduction in the quantity of wood necessary to frame and provide nailer surfaces to which the wallboard can be fastened at the junction typified by junction 1400. The ceiling wallboard typified by 1403 and the partition wall wallboard typified by 1404 are, by the presently existing construction techniques, fixed to separate framing members, namely the top plate and straps respectively. These members, although fastened together with nails, are subject to movements because of the drying, twisting, shrinking, warping and lifting associated with such wooden members, thus causing cracking, splitting, separating of these corner junctions. Because the metal angle bar are of one manufactured piece construction to which the wallboards are fastened and are not subject to the drying, twisting, shrinking, warping and lifting characteristic of wooden members, the filled and finished wallboard junctions do not crack, separate or split open.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. An integral metal structural post for the erection of two pairs of interior walls, each of said pair of walls including two interior walls which are disposed at right angles to one another, said post comprising A) a first elongate metal angle bar, said first elongate metal angle bar having an "L"-shaped cross-section, and having a first arm and a second arm which are disposed at right angles to one another, each said arm having an exterior face and an interior face, the interior face of said first arm of said first elongate metal having a sufficiently rough surface for gripping a tip of a self-tapping screw to cause said self-tapping screw to enter said first arm of said first elongate metal angle upon application of torque to said self-tapping screw, and the interior face of said second arm of said first elongated metal angle bar having a sefficiently rough surface for gripping a tip of a self-tapping screw to cause the self-tapping screw to enter said second arm of said first elongate metal bar upon application of torque to said self-tapping screw;

B) a second elongate metal angle bar, said second elongate metal angle bar having an "L"-shaped cross-section and having a first arm and a second arm which are disposed at right angles to one another, each said arm having an exterior face and an interior face, the interior face of said first arm of said second elongate metal angle bar gaving a sufficiently rough surface for gripping a tip of a self-tapping screw to cause said self-tapping screw to enter said first arm of said second elongated metal angle bar upon application of torque to said self-tapping screw, and said second arm of said second elongate metal angle bar having a sufficiently rough surface for gripping a tip of a self-tapping screw to cause said self-tapping screw to enter said second arm of said second elongated metal angle bar upon application of torque to said self-tapping screw; and C) an elongate web connecting the exterior face of said second arm of said first elongate metal angle bar to the exterior face of said second arm of said second elongate metal angle bar, the interior face of said first arm of said elongate metal angle bar being separated from the interior face of said first arm of said second elongate metal angle bar by a distance providing an elongate channel therebetween, said elongate channel being sufficient to accommodate a top plate or a bottom shoe therein, said first arm of said elongate metal angle bar, and said first arm of said second elongate metal angle bar each being provided with respective, inwarding-facing, centrally-oriented flanges, each of said flanges commencing at a region which in spaced from the top of a respective said elongate metal angle bar and terminating at a region which is space from the bottom of a respective said elongate metal angle bar;

wherein said first arm of said first elongate metal bar thus has means for securing a first interior wallboard or interior sheathing directly to said interior face of said first arm of said first elongate metal angle bar by means of self tapping screws, and wherein said second arm of said first elongate metal angle bar thus has means for securing a second interior wallboard or interior sheathing directly to said interior face of said second arm of said first elongate metal bar by means of self-tapping screws, said second interior wallboard or interior sheathing being securable at right angles to said first interior wallboard or interior sheathing; and wherein said first arm of said second elongate metal angle bar thus has means for securing a third interior wallboard or interior sheathing directly to said interior face of said first arm of said second elongate metal angle bar by means of self-tapping screws, and wherein said second arm of said second elongate metal bar thus has means for securing a fourth interior wallboard or interior sheathing directly to said second arm of said second elongate metal angle bar by means of self-tapping screws, said fourth interior wallboard or interior sheathing being securable at right angles to said third interior wallboard or interior sheathing.

2. A framing system comprising the structural post of claim 1, and also including a top plate which is disposed within said channel and which is secured to the inner face of said first arm of said first elongate metal angle bar and to the inner face of said first arm of said second elongate metal angle bar at right angles to said elongate web at the top of said post, above said flanges, and also including a bottom shoe which is disposed within said channel and which is secured to the inner face of said first arm of said first elongate metal angle bar and to said inner face of said first arm of said second elongate metal angle bar at right angles to said elongate web at the bottom of said post.

3. The framing system of claim 2 wherein said top plate and said bottom shoe are each rectangular wooden members.

4. The framing system of claim 2 wherein said top plate and said bottom shoe are each U-shaped metal members.

5. The structural post of claim 1 wherein said elongate web is provided with longitudinally spaced-apart apertures.

6. The structural post of claim 5 wherein said apertures are fitted with removable hollow plastic cylinders.

7. Two interior corners consisting of two pairs of interior walls, each of said pair of interior walls including two walls which are disposed at right angles to one another, said interior corners comprising:

(I) a metal structural post, said metal structural post comprising the combination of: (A) a first elongate metal angle bar, said first elongate metal angle bar having an "L"-shaped cross-section, and having a first arm and a second arm which are disposed at right angles to one another, each said arm having an exterior face and an interior face , the interior face of said first arm of said first elongate metal having a sufficiently rough surface for gripping a tip of a self-tapping screw to cause said self-tapping screw to enter said first elongate metal angle upon application of torque to said self-tapping screw, and the interior face of said second arm of said first elongate metal angle bar having a sufficiently rough surface for gripping a tip of a self-tapping screw to cause said self-tapping screw to enter said second arm of said first elongate metal bar upon application of torque to said self-tapping screw; B) a second elongate metal angle bar, said second elongate metal angle bar having an "L"-shaped cross-section, and having a first arm and a second arm which are disposed at right angles to one another, each said arm having an exterior face and an interior face, the interior face of said first arm of said second elongate metal angle bar having a sufficiently rough surface for gripping a tip of a self-tapping screw to cause said self-tapping screw to enter said first arm of said second elongate metal angle bar upon application of torque to said self-tapping screw, and said second arm of said second elongate metal angle bar having a sufficiently rough surface for gripping a tip of a self-tapping screw to cause said self-tapping screw to enter said second arm of said second elongate metal bar angle upon application of torque to said self-tapping screw; and C) an elongate web connecting the exterior face of said second arm of said first elongate metal angle bar to the exterior face of said second arm of said second elongate metal angle bar, the interior face of said first arm of said first elongate metal angle bar being separated from the interior face of said first arm of said second elongate metal angle bar by a distance providing an elongate channel therebetween, said elongate channel being sufficient to accommodate a top plate or a bottom shoe therein, said first arm of said first elongate metal angle bar of said first arm of said second elongate metal angle bar each said first arm being provided with respective, inwardly-facing, centrally-oriented flanges, each of said flanges commencing at a region spaced from the top of a respective said elongate metal angle bar and terminating at a region spaced from the bottom of a respective said elongate metal angle bar;

(II) a top plate which is disposed within said channel and is secured to the interior face of said first arm of said first elongate metal angle bar and to the interior face of said first aim of said second elongate metal angle bar at right angles to said elongate web at the top of said post, above said flanges; and (III) a bottom shoe which is disposed within said channel and is secured to the interior face of said first arm of said first elongate metal angle bar and to said interior face of said first arm of said second elongate metal angle bar at right angles to said elongate web at the bottom of said post;

(IV) a first interior wallboard or interior sheathing which is secured directly to said interior face of said first arm of said first elongate metal angle bar by means of self-tapping screws, and a second interior wallboard or interior sheathing which is secured directly to said interior face of said second arm of said second elongated metal bar by means of self-tapping screws, said second interior wallboard or interior sheathing being secured at right angles to said first interior wallboard or interior sheathing, thereby to provide one interior corner; and (V) a third interior wallboard or interior sheathing which is secured directly to said interior face of said first arm of said second elongate metal angle bar by means of self-tapping screws, and a fourth interior wallboard or interior sheathing which is secured directly to said interior face of said second arm of said second elongate metal angle bar by means of said self-tapping screws, said fourth interior wallboard or interior sheathing being secured at right angles to said third interior wallboard or interior sheathing, thereby to provide a second corner.

8. The two interior corners of claim 7 wherein said top plate and said bottom shoe are each rectangular wooden members.

9. The two interior corners of claim 7 wherein said top plate and said bottom shoe are each U-shaped metal members.

10. The two interior corners of claim 7 wherein said elongate web is provided with a plurality of longitudinally spaced-apart apertures.

11. The two interior comers of claim 10 wherein said apertures are fitted with removable hollow plastic cylinders.

* * * * *